United States Patent [19]

Woodruff

[11] 4,160,467

[45] Jul. 10, 1979

[54] HAND LOOM HAVING ROTARY HEDDLE ASSEMBLY

[76] Inventor: Jed R. Woodruff, 3042 N. 175 W., North Ogden, Utah 84404

[21] Appl. No.: 867,196

[22] Filed: Jan. 5, 1978

[51] Int. Cl.[2] ..... D03D 29/00; D03C 13/00

[52] U.S. Cl. ..... 139/33; 139/55.1

[58] Field of Search ..... 139/28–34, 139/55.1; 28/151, 152

[56] References Cited

U.S. PATENT DOCUMENTS

| | | | |
|---|---|---|---|
| 410,772 | 9/1889 | Scherer | 139/33 |
| 760,919 | 5/1904 | Poole | 139/29 |
| 1,160,132 | 11/1915 | Bliss | 139/33 |

FOREIGN PATENT DOCUMENTS

| | | | |
|---|---|---|---|
| 507635 | 10/1951 | Belgium | 139/34 |
| 906435 | 5/1945 | France | 139/33 |
| 1417247 | 10/1965 | France | 139/33 |
| 457989 | 6/1950 | Italy | 139/29 |
| 515649 | 2/1955 | Italy | 139/33 |
| 162435 | 9/1933 | Switzerland | 139/29 |
| 2353 of | 1799 | United Kingdom | 139/29 |
| 796507 | 6/1958 | United Kingdom | 139/33 |

*Primary Examiner*—James Kee Chi

*Attorney, Agent, or Firm*—David B. Harrison

[57] ABSTRACT

A hand loom for making woven fabric is disclosed. The loom includes a frame for supporting warp threading. Warp alignment structure on the frame maintains relative alignment of each thread of the warp. A detachable heddle spindle assembly mounted to the frame includes a rotatably mounted heddle spindle transversely adjacent the warp threading. A first set of slideably positionable heddle fingers is removably installed in a locking slot formed axially on the spindle and the fingers thereof are adapted, aligned and spaced to lift predetermined ones of the warp threading as the spindle is rotated. A second set of heddle fingers is removably installed in a second locking slot axially on the spindle and radially displaced from the first set, the fingers of the second set being adapted, aligned and spaced to lift others of the warp threads. The spindle is rotated so that the first set of heddle fingers lifts some of the warp threads, a weft drawing shuttle may then be passed between the lifted threads and the remaining warp, and so on until the woven fabric is completed. The heddle fingers may have a variety of arrangements and may be programmable so that an unlimited variety of woven patterns may be woven. The warp threading may be installed as a single thread at one side of the frame and then coiled longitudinally thereabout to a desired width, or separate threads may be mounted around the frame to provide warp. A tension adjusting mechanism is provided to bias the warp to a desired tension.

22 Claims, 17 Drawing Figures

FIG. 1
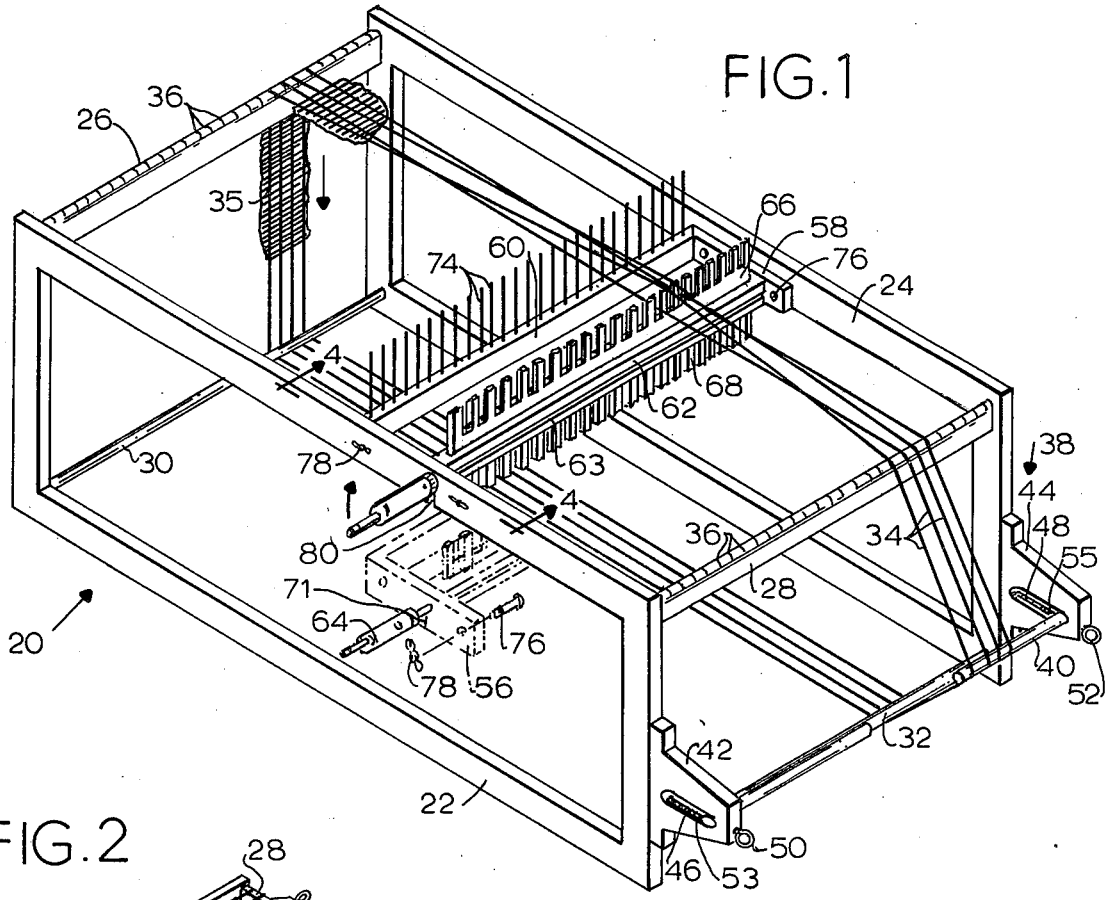
FIG. 2
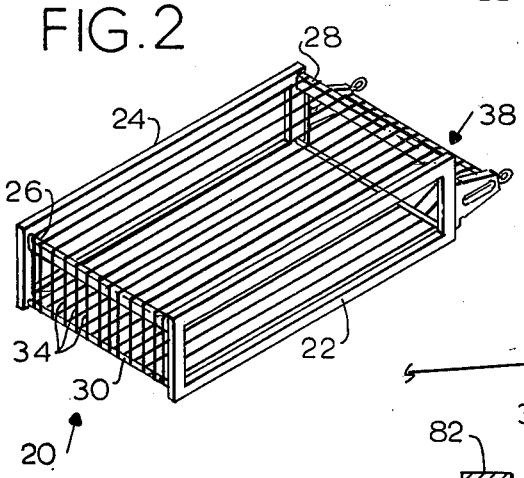
FIG. 5
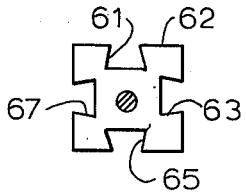
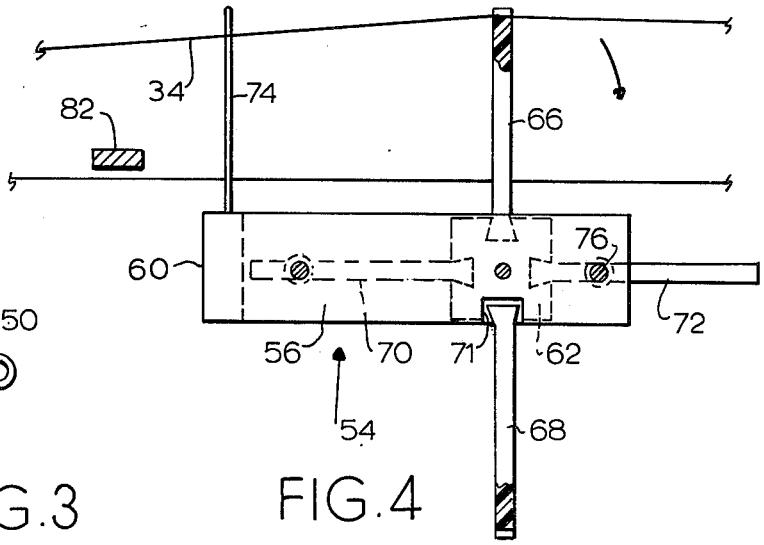
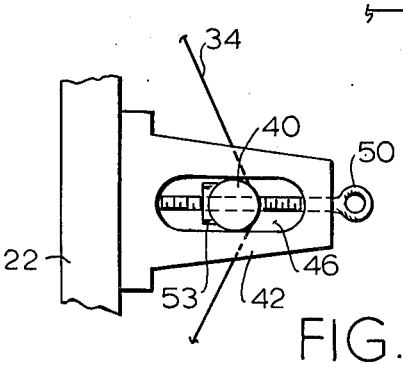
FIG. 3
FIG. 4

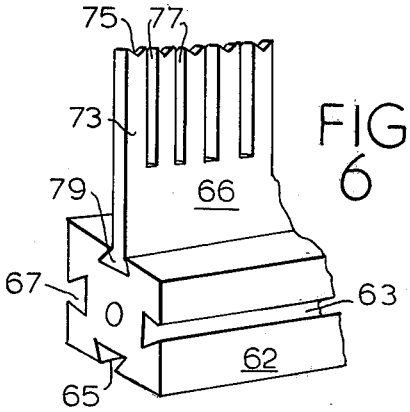
FIG. 6
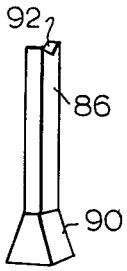
FIG. 7
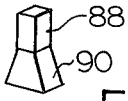
FIG. 8
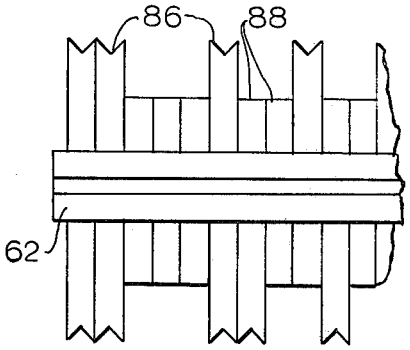
FIG. 9
FIG. 10
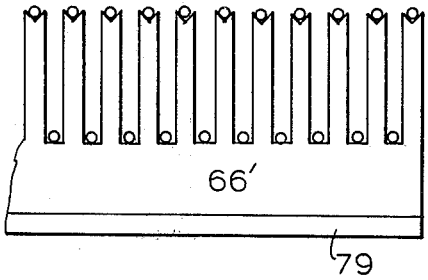
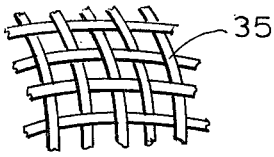
FIG. 11
FIG. 12
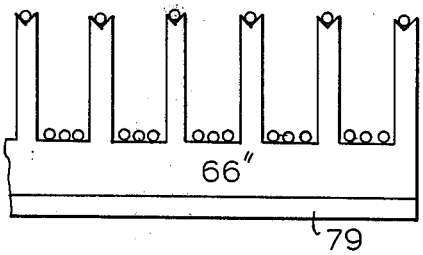
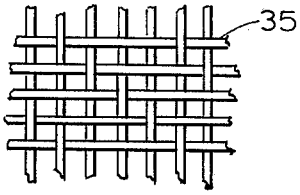
FIG. 13
FIG. 14
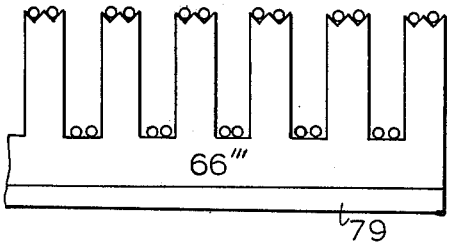
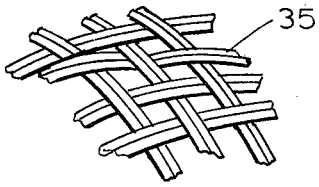
FIG. 15

HAND LOOM HAVING ROTARY HEDDLE ASSEMBLY

BACKGROUND OF THE INVENTION

The present invention relates to hand operated looms and more particularly relates to a hand loom having a rotating programmable heddle assembly.

Hand looms have been known since ancient times, and hand looms having rotating heddle assemblies have also been known for some time. For example, U.S. Pat. No. 1,160,132 to Bliss disclosed a hand loom in which a rotary heddle assembly was mounted to a frame. Heddle bars having notches of differing depths were secured in the heddle spindle and those notches engaged the warp threads, some of the notches being very shallow and lifting some of the warp threads higher than the notches which were much deeper. The shuttle was then passed between the displaced warp threads. Then, the heddle assembly was rotated, and the process repeated. The Bliss patent had the drawbacks of not having individually programmable heddle assemblies, and also lacked any provision for tensioning the warp threading. Moreover, the frame of the Bliss loom was not adapted to support the warp threading as a continuous belt thereabout.

U.S. Pat. No. 410,772 to Scherer disclosed a complex form of hand operated loom in which the heddle included threaded fingers and spacers which were programmable in the sense that they were manually assembled into one predetermined pattern only. The Scherer patent also had the drawback of the requirement of having to thread each of the warp threads through each heddle finger which was a slow and cumbersome operation.

U.S. Pat. No. 2,150,187 to Raba, et al. disclosed a hand loom having a conventional heddle of upstanding finger guides which would align the warp threads, with the warp in the form of a belt extending about the loom. The difficulty with the Raba, et al. type of loom was not only the time and effort required to engage the heddle with the warp, but also the inability to change the weaving pattern except with great difficulty.

U.S. Pat. No. 2,209,597 to Clark, et al. described a hand loom in which the warp extended as a belt about the frame of the loom and wherein there was a tensioning device which engaged the warp belt to provide a predetermined bias thereon. The heddle assembly was conventional and had to be manually connected to each of the warp threads.

SUMMARY OF THE INVENTION

One object of the present invention is to provide an improved hand loom which is simple and straight forward in construction and operation, and which overcomes the disadvantages and drawbacks of the prior art hand looms.

Another object of the present invention is to provide a hand loom with a rotatable heddle assembly wherein heddle fingers lift warp threads, and wherein the arrangement of heddle fingers may readily be changed to vary the pattern of the woven fabric without rewarping the loom.

It is a further object of the present invention to provide a hand loom facilitating easy installation of warp threading by coiling a single warp thread about the loom frame.

It is a still further object of the present invention to provide a hand loom which facilitates easy advance of the warp threading as a belt about the entire frame of the loom.

It is yet another object of the present invention to provide a hand loom which is elegantly simple in design, has few moving parts, is reliable in use, is attractive in appearance, and is easily manufactured at low cost out of a variety of suitable materials.

These and other objects and advantages are accomplished by a hand loom which includes a frame for supporting warp threading installed longitudinally thereabout and moveable as a belt. The frame includes structure for maintaining the relative alignment of each thread of the warp threading wound thereon. A hand operated shuttle or needle is provided to which a weft thread is attached for movement transversely through the warp threading. A heddle spindle is rotatably mounted to an assembly removably attached to the frame, and the spindle is positioned transversely adjacent to the warp threads. A first set of heddle fingers is removable installed in axial alignment along the heddle spindle, the fingers being adapted and spaced to lift predetermined ones of the warp threading. A second set of heddle fingers in also removably installed in axial alignment along the heddle spindle and radially displaced from the first set of heddle fingers, the fingers of the second set being adapted and spaced to lift predetermined others of the warp threading. As the spindle means is rotated, the first set of heddle fingers lift the ones of the warp and the shuttle is passed therethrough; then the spindle is rotated so that the second set of heddle fingers lifts the others of the warp threading and the shuttle is then moved again therethrough, with the process of rotating the spindle and passing the shuttle back and forth being repeated until the warp is completely woven to provide the fabric. The heddle fingers may be separate and interspersed with spacers so as to be programmable before as well as during weaving operations. During the weaving operation and during storage between weaving sessions, it is necessary to adjust the bias or tension of the warp threading, and an adjustment mechanism is provided for this purpose.

Other objects, advantages and features of the invention will become apparent from the following detailed description of the preferred embodiments presented in conjunction with the accompanying drawings.

BRIEF DESCRIPTION OF THE DRAWINGS

In the drawings:

FIG. 1 is a perspective view of a hand loom constructed in accordance with the principles of the present invention, with a demountable heddle spindle assembly shown in solid lines in place and in broken lines reoved from the frame, yet positioned for upward movement into operating position and attachment. A portion of the tensioning bar is broken away and only four coils of the warp are shown.

FIG. 2 is a slightly reduced perspective view of the frame shown in FIG. 1 the warp threading coiled about the frame; showing the heddle spindle assembly has not yet been mounted.

FIG. 3 is an enlarged fragmentary view in side elevation of the warp tension adjustment mechanism of the loom shown in FIG. 1.

FIG. 4 is a view in side elevation and section of the heddle spindle assembly taken along the line 4—4 in FIG. 1.

FIG. 5 is an end view in elevation of the heddle spindle with the heddle finger sets removed therefrom.

FIG. 6 is a fragmentary perspective view of the heddle spindle with one heddle finger set installed therein.

FIG. 7 is a view in perspective of a single programmable heddle finger.

FIG. 8 is a view in perspective of a single programmable heddle spacer.

FIG. 9 is a view in elevation of the heddle spindle in which programmable heddle fingers and spacers have been arranged to provide a unique weaving pattern.

FIG. 10 is a fragmentary view in side elevation of a portion of one heddle set spaced and aligned to produce a standard or "tabby" pattern in woven fabric.

FIG. 11 is a perspective view of a portion of a standard fabric pattern produced with two of the heddle sets of FIG. 10.

FIG. 12 is a fragmentary view in elevation of another heddle set used to produce a twill pattern in the woven fabric.

FIG. 13 is a plan view of the twill pattern produced with four of the heddle sets shown in FIG. 12.

FIG. 14 is a heddle set having double fingers and spacers which is aligned and spaced to produce a basket weave pattern.

FIG. 15 is a perspective view of a portion of a basket weave pattern made with two of the heddle sets of FIG. 14.

DETAILED DESCRIPTION OF PREFERRED EMBODIMENTS

Figure 16:
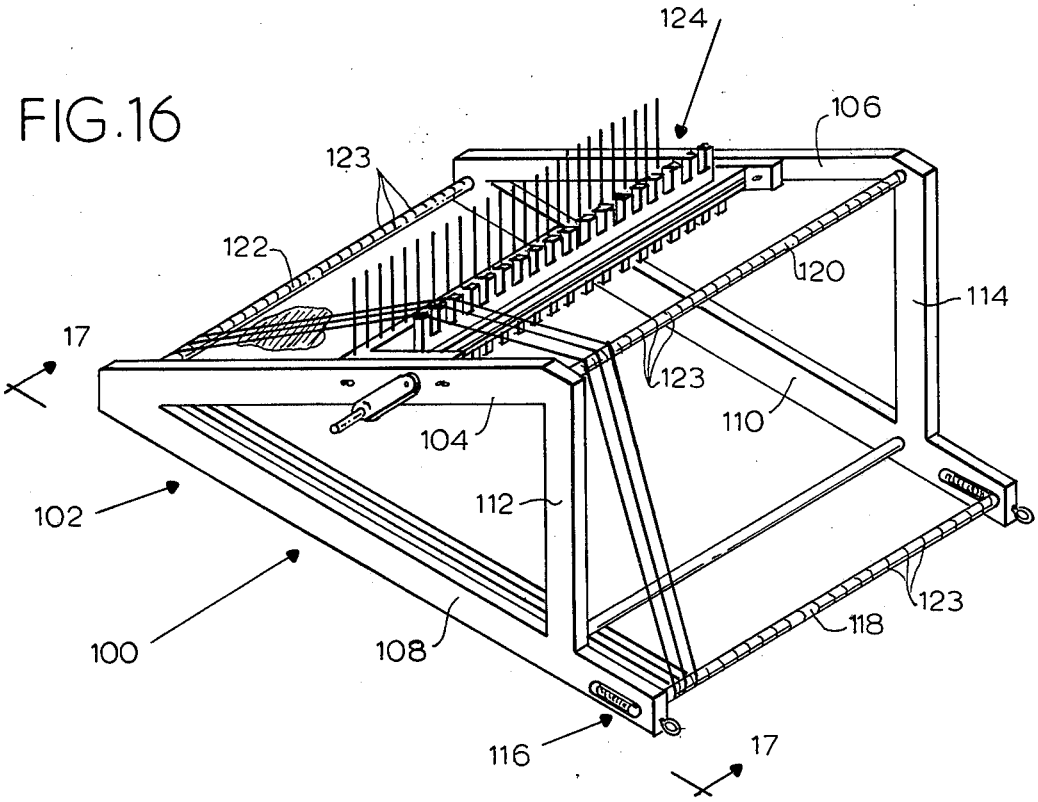
FIG. 16 is a perspective view of an alternative form of hand loom constructed in accordance with the principles of the present invention and having the same functional elements as are present in the hand loom construction shown in FIG. 1 and discussed in connection therewith.

With reference to the drawings, FIG. 1 depicts a hand loom 20 constructed in accordance with the present invention. The loom 20 includes a rectangular front side frame 22, a geometrically identical back side frame 24, and four transverse members 26, 28, 30 and 32 which interconnect the corners of the frames 22 and 24. A single thread 34 is coiled helically around the loom between, and in longitudinal alignment with, the front side 22 and the back side 24 to provide warp for the loom 20. In FIG. 1 only four coils of the warp 34 are shown, whereas in FIG. 2, the depth of the loom 20 is covered by coils of the warp thread 34. The relative positional alignment of each coil of the thread 34 is established and maintained by positioning grooves 36 present in the upper transverse members 26 and 28. A small section of woven fabric 35 is also depicted in FIG. 1. As the hand weaving progresses, the warp is periodically rotated as a belt counterclockwise around the frame of the loom 20.

The tension of the coiled warp threading is fixed by a tensioning mechanism 38 which includes a bias rod 40 around which the thread 34 is passed, as shown in FIG. 3. The bias rod 40 is slideably mounted within a slot in each of two end brackets 42 and 44. The end bracket 42 is secured to the right side of the front frame 22, and the bracket 44 is secured to the right side of the back frame 24. The slots 46 and 48 provided in the brackets 42 and 44 enable the rod 40 to slide back and forth therein and thereby fix the longitudinal tension of the warp coil 44. Eyebolts 50 and 52 are journalled through the rightmost ends of the brackets 42 and 44. The bolts 50 and 52 pass through the rod 40 and engage nuts 53 and 55 which are seated in suitable recesses in the rod, so that when the eyebolts 50 and 52 are rotated, the rod 40 is moved in a longitudinal direction to control the tension of the warp coil 34.

As shown in FIGS. 1 and 4, the loom 20 includes a spindle assembly 54. The spindle assembly 54 includes a U-shaped bracket having a front side member 56, a back side member 58, and a transverse member 60 rigidly joined between the front and back members 56 and 58. A spindle 62 is rotatably journalled through the front side members 56 and 58 and is connected to a crank 64 which enables an operator to operate the spindle 62 by rotation of the crank 64. As shown in FIGS. 4 and 5, the spindle 62 is substantially square in cross section, and it is provided with four axially extending dove-tail or inverse wedge shaped grooves 61, 63, 65 and 67, along the extent of each major surface. The slots 61, 63, 65 and 67 are sized and shaped to receive heddle finger and spacer sets 66, 68, 70 and 72, as shown in FIG. 4. A notch 71 in the front side member 56 of the spindle assembly 54 enables the heddle finger sets 66, 68, 70 and 72 to be slid in and out of the grooves 61, 63, 65, and 67, not only when the assembly 54 is removed, but also during weaving operations when it is secured to the frame 20.

The heddle sets 66, 68, 70 and 72 each includes a series of transverse and spaced apart fingers 73 having notches 75 in the upper ends thereof as shown in FIG. 6. The fingers 73 are separated by spacers 77. The heddle sets 66, 68, 70 and 72 include wedge shaped feet 79 which are sized and shaped to slide closely within the dove-tail grooves 61, 63, 65 and 67 as best shown in FIG. 6 and somewhat shown in FIG. 4. The fingers 73 and spacers 77 of each of the heddle sets 66, 68, 70 and 72 are offset relative to the other sets in the transverse dimension so that as the spindle 62 is rotated, by rotation of the crank 64, different ones of the warp threading 34 are lifted by the heddle sets 66, 68, 70 and 72. In this way, a shuttle or needle 82 carrying a weft thread may be passed between the lifted ones and unlifted others of the warp threading 34 to provide the woven fabric 35 as shown in FIG. 1.

The spindle assembly 54 also preferably includes a series of spaced apart vertically extending guide rods 74 mounted in the transverse frame member 60. The rods 74 extend just above the fingers of each heddle set and serve to maintain the warp threading 34 in relative alignment during the periodic rotations of the spindle 62 and concomitant movements of the shuttle 82 through the warp.

After the thread 34 has been coiled about the frame of the loom 20 to provide the warp as shown in FIG. 2, the spindle assembly 54 is then installed by external movement into the open space of the frame of the loom 20 and then vertical movement until the rods 74 pass between the warp 34. Four bolts 76 are provided for mounting the end members 56 and 58 to the top segments of the front and rear frames 22 and 24. Wing nuts 78 are then threaded onto the bolts 76 and secure the spindle assembly in position. A notch 80 is provided in the lower edge of the top segment of the frame front 22, and it accommodates the shaft of the crank 64.

One feature of the present invention is that the spindle 62 is adapted to receive fixed heddle sets 66, 68, 70 and 72, as shown in FIGS. 4 and 6. In addition, the heddle sets may be made up of individually programmable fingers 86 and spacers 88 to provide weaving patterns. This feature is illustrated in FIGS. 7, 8 and 9. FIG. 7 shows an individual finger 86 including a wedge-shaped foot 90 and an upper notch 92. The wedge-shaped foot 90 is sized and shaped to slide closely within the dove-tail notches 61, 63, 65 or 67 extending along the length of the spindle 62. A spacer 88 shown in FIG. 8 is identical with the finger 86 except that it is truncated shortly above the foot region 90 thereof. A unique combination of assembled fingers 86 and spacers 88 is illustrated in FIG. 9 which shows a side view in elevation of the spindle 62. Locks would be installed at each end of the dove-tail notches 61, 63, 65 or 67 to hold the assembled heddle set of fingers 86 and spacers 88 together in the correct position and relative alignment with respect to the warp threading. For example, the locks might be slightly oversized wedge shaped plugs which interfere with the sidewalls of the notches 61, 63, 65 or 67.

Two unitary heddle sets are required to produce a standard woven fabric. One heddle set 66' thereof is illustrated in FIG. 10, and the resultant pattern 35 is shown in FIG. 11. The heddle sets are identical except in that they are offset by one thread so that as the heddle set 66' is moved into position, it lifts every other one of the warp threads 34 while the other set lifts the opposite threads, so that as the weft thread is passed between the separated strands of the warp threading 34, the pattern shown in FIG. 11 is woven.

Four heddle sets are required to produce a twill pattern. In FIG. 12, one of the heddle sets, 66" is shown and the resultant pattern is illustrated in FIG. 13. A basket weave pattern may be produced with yet another pair of heddles, one of which being shown in FIG. 14 as 66''' and the resultant basket weave pattern being shown in FIG. 15.

The loom 20 may be constructed of any suitable material such as wood, plastic or lightweight metal. The heddle finger sets are preferably made of a metal or plastic material. Individual heddle fingers 86 and spacers 88 are also preferably of metal or plastic.

The threading and operation of the loom 20 will now be explained, particularly with reference to FIGS. 1, 2, 3 and 4. First the spindle assembly 54 is removed from the frame of the loom 20 by removal of the wing nuts 78 and withdrawal of the bolt 76. The spindle assembly then drops into the open middle part of the frame of the loom 20 and is easily withdrawn.

Next, a warp thread 34 is tied to one of the transverse members 26, 28, 30 or 32 at a corner thereof, and the warp thread is then coiled around the transverse members with the number of turns or coils fixing the width of the woven fabric. If, e.g., a tweed of varying colors is to be woven, multiple warp threads may alternatively be banded about the frame of the loom in lieu of a single coiled thread 34. Once the warp 34 is in place, each end of the warp thread is tied to an adjacent strand thereof, so that the warp threading is capable of moving as a belt or band around the loom as the weaving progresses.

The next step is to program the spindle assembly 54 by insertion into the grooves of the spindle 62 of the desired heddle finger sets, whether they are unitary or whether they be assembled of individual fingers 86 and spacers 88. Once the spindle assemble 54 is programmed and its relative alignment verified, it may then be installed in the frame of the loom 20 by placing it within the open space in the middle of the loom, and then moving it upwardly, so that the fingers 74 come between each of the warp threads 34 and maintain the separation thereof. The bolts 76 are then installed and the nuts 78 are then secured in place. It should be understood that the spindle assembly 54 may be programmed during weaving operations in order to alter a weaving pattern in the fabric 35. The slots 71 in the assembly 54 and the notch 80 in the lower edge of the top segment of the frame front 22 when linearly aligned enable heddle sets to be changed while the assembly 54 remains in place.

The next step is to adjust the tension of the warp threading 34 by manipulation of the eyebolts 50 and 52 of the tensioning mechanism 38. In this regard, it is wise to thread the warp threading 34 with the bias rod 40 midpoint in its relative position, i.e., as it is shown in the detail view of FIG. 3.

Next a weft thread is attached to the shuttle 82, and weaving commences by lifting some of the warp threads 34 with one heddle set, passing the shuttle 82 through the separated threads of the warp, rotating the spindle so that another heddle set lifts other warp threads, and repeating the movement of the shuttle 82. As shown in FIG. 4, the shuttle is passed back and forth on the side of the upstanding finger guides 74 which is opposite the spindle 62. From time to time, the bias on the warp threading 34 is relaxed by movement of the tension rod 40, and the woven fabric 35 is then advanced longitudinally. Tension is thereafter restored, and weaving is continued in the above described manner. It has been found particularly advantageous to rotate the spindle 62 in a direction which brings each heddle set into contact with the warp immediately adjacent the finger guide 74. In the embodiment shown in FIG. 1, this is accomplished by a clockwise rotation of the crank 64 as shown by the arced arrow.

Figure 17:
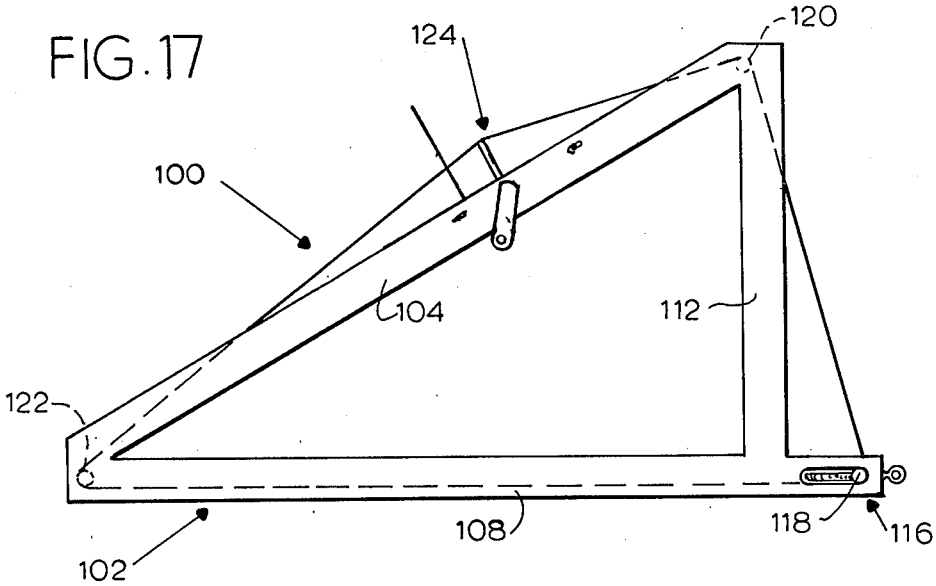
FIG. 17 is a side view in elevation of the hand loom shown in FIG. 16.

Another form of loom 100 embodying the principles of the present invention is shown in FIGS. 16 and 17. This loom 100, of generally triangular geometry differs from the loom 20 shown in FIGS. 1 and 2 only in terms of the configuration of its frame 102. The frame 102 includes front and back diagonal members 104 and 106, front and back bottom members 108 and 110, and front and rear vertical members 112 and 114.

The bottom members 108 and 110 extend outwardly beyond the vertical members 112 and 114 and together form a tensioning assembly 116 having a transverse tensioning rod 118. An upper, fixed transverse member 120 and a lower end fixed transverse member 122 join the front and rear portions of the frame 102 together to provide structural integrity therein. In the loom 100, these members 120, 122 are round, and if wood dowels, may be turned on a lathe to provide notches 123 around which the warp may be threaded for weaving.

A heddle spindle assembly 124 is mounted between the front and rear diagonal members 104 and 106. The assembly 124 may be identical to the assembly 54, already described and its details will not be repeated here.

The threading of warpage and weaving operations on the 100 are the same as with the loom 20.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A hand loom for making woven fabric comprising:
frame means for supporting warp threading installed longitudinally as a band about the periphery thereof and providing a shuttle location thereon;
warp alignment means on said frame means for maintaining the relative alignment of each thread of warp threading at said shuttle location;
warp threading installed as a band in longitudinal alignment about the periphery of said frame means;
hand operated shuttle means to which a weft thread is attached for movement transversely through predetermined ones of said warp threading at said shuttle location;
transverse demountable heddle spindle means rotatably mounted in an operating position at the periphery of said frame means adjacent to said shuttle location generally perpendicular to said warp threading, and removable from said frame means to facilitate installation of said warp threading;
a first set of slideably positionable heddle fingers retained in a first locking slot in said spindle means lying in a plane in axial alignment along said heddle spindle means, each finger extending radially outward from said first slot, said fingers adapted and positioned to lift predetermined ones of said warp threading;
at least a second set of slideably positionable heddle fingers retained in a second locking slot in said spindle means lying in a plane in axial alignment along said heddle spindle means and radially displaced from said first set of heddle fingers to a position out of contact with said warp threading when said first set is brought into contact therewith by rotation of said spindle means, each finger extending radially outward from said second slot, the fingers of said second set adapted and positioned to lift predetermined others of said warp threading as said spindle means is rotated;
whereby said woven fabric is made when said spindle means is rotated so that said first set of heddle fingers lifts said predetermined ones of said warp threading, said shuttle means is then passed between said warp threading and said lifted ones thereof, said spindle means is then rotated so that said second set of heddle fingers lifts said predetermined others, said shuttle means is again moved therebetween, with the foregoing process repeated to provide said woven fabric.

2. The hand loom set forth in claim 1 further comprising releasable warp tensioning means on said frame means for biasing said warp threading to a predetermined tension during weaving and enabling said warp threading to be moved in a longitudinal direction when said tensioning means is released.

3. The hand loom set forth in claim 1 wherein said frame means includes a first side member, a second side member substantially parallel with and offset from said first member, a plurality of transverse warp support members extending between said first and second side members, and adapted to guide said warp setting.

4. The hand loom set forth in claim 3 wherein said warp alignment means is provided on at least one of said transverse warp guide members.

5. The hand loom set forth in claim 4 wherein said warp alignment means comprises a series of spaced apart notches on the outer sides of two transverse warp guide members between which said heddle spindle means is mounted.

6. The hand loom set forth in claim 1 wherein said heddle spindle means includes a transverse series of fixed, spaced apart, vertical warp thread guides adjacent to said first and second sets of heddle fingers.

7. The hand loom set forth in claim 1 wherein a set of heddle fingers comprises an arranged series of discrete fingers and discrete spacers positioned in a corresponding said locking slot.

8. The hand loom set forth in claim 1 wherein said heddle spindle means is provided with a series of three or more sets of heddle fingers.

9. The hand loom set forth in claim 1 wherein a said locking slot comprises a mortise formed in said heddle spindle means and the base of a corresponding said set of slideably positionable heddle fingers comprises a tenon slideably engageable with said mortise to provide a dovetail.

10. The hand loom set forth in claim 7 wherein said discrete fingers are arranged in a series of spaced apart groups of adjacent fingers so that adjacent strands of warp threading are engaged by each group to enable a basketweave pattern to be woven by operation of said loom.

11. A hand loom for making woven fabric comprising:
(a) a frame including a front side member, a back side member substantially symmetrical with said front side member, and transverse warp support members fixed between said front and back side members at the corners thereof, two of said transverse warp support members at the top corners of said frame each having a series of spaced apart notches on an outer surface for aligning warp threads;
(b) warp threading installed as a moveable band longitudinally around said transverse warp support members so that said warp threading is generally located at the periperhy of said frame;
(c) a removable heddle spindle assembly mounted transversely between said front and back side members at the top of said frame generally midway between the corners thereof, said spindle assembly including
(i) a subframe,
(ii) a rotatable spindle shaft extending transversely across said frame adjacent to said warp threading and journalled through opposite end members of said subframe,
(iii) a crank attached to said shaft and extending beyond the front side member of said frame,
(iv) a first set of spaced apart, slideably positionable heddle fingers removably mounted in a first, axially aligned peripheral locking slot defined along said spindle shaft, said fingers extending radially therefrom and each having a notch at the outer end thereof for lifting predetermined ones of warp threading,
(v) at least a second set of spaced apart, slideably positionable heddle fingers removably mounted in a second, axially aligned peripheral locking slot defined along said spindle shaft and radially displaced from said first set of heddle fingers to a position out of contact with said warp threading when said first set is brought into contact therewith by rotation of said spindle shaft, each finger of said second set extending radially from said shaft and having a notch at the outer end thereof for lifting predetermined ones of warp threading not lifted by a finger of said first set;

(d) hand operated shuttle means to which a weft thread is attached for movement transversely through said warp threading adjacent said heddle spindle assembly;

whereby said heddle spindle assembly is removed to facilitate installation of said warp threading, said assembly then being installed in place, said shaft then rotated until fingers of said first set lift some of said warp threads, said shuttle means is then passed through said warp threading, said shaft is then rotated until fingers of said second set lift others of said warp threads, said shuttle means is then again passed through said warp threading and the foregoing operations continued until said woven fabric is thereby provided.

12. The hand loom set forth in claim 11 wherein said frame is generally rectangular and includes at least four transverse warp support members.

13. The hand loom set forth in claim 11 wherein said removable heddle spindle assembly additionally comprises a transverse series of spaced apart, transversely disposed thread guides mounted to a transverse portion of said subframe, said guides for maintaining the relative alignment of said warp threads as some thereof are lifted by fingers as the heddle shaft is rotated from one finger set to another.

14. The hand loom set forth in claim 1 wherein a set of heddle fingers comprises an arranged series of discrete fingers and discrete spacers positioned in a corresponding said locking slot.

15. The hand loom set forth in claim 11 additionally comprising a transverse tensioning bar adjustably mounted to said frame, over which said warp is positioned whereby adjustment of spatial position of said bar relative to said frame varies tension of said warp threading.

16. The hand loom set forth in claim 11 wherein said spindle shaft is provided with a series of three or more sets of heddle fingers.

17. The hand loom set forth in claim 11 wherein said frame is generally wedge shaped.

18. The hand loom set forth in claim 17 wherein said front side member and said back side member each comprise a bottom horizontal segment, a vertically extending segment, extending upwardly from one end region of said bottom segment, and a diagonal segment extending between an upper end of said vertical segment and the other end of said bottom segment which is opposite the end region from which said vertical segment extends.

19. The hand loom set forth in claim 18 wherein said removable heddle spindle means is mounted between the diagonal segments of said front and back side members.

20. The hand loom set forth in claim 18 further comprising a transverse tensioning bar adjustably mounted at said one end region of said front and back side members at a location outside of the location at which said vertical members extend upwardly therefrom, said tensioning bar for engaging and tensioning said warp when installed thereover as it is moved spatially relative to said frame.

21. The hand loom set forth in claim 11 wherein said locking slot comprises a mortise formed in said rotatable spindle shaft and the base of a corresponding said set of slideably positionable heddle fingers comprises a tenon slideably engageable with said mortise to provide a dovetail.

22. The hand loom set forth in claim 14 wherein said discrete fingers are arranged in a series of spaced apart groups of adjacent fingers so that adjacent strands of warp threading are engaged by each group to enable a basketweave pattern to be woven by operation of said loom.

* * * * *